United States Patent [19]

Harbeke

[11] Patent Number: 4,877,216

[45] **Date of Patent: * Oct. 31, 1989**

[54] AUTOMATICALLY-RELEASABLE PIPE-ATTACHMENT DEVICE

[76] Inventor: Gerold J. Harbeke, 2443 Waterside Cir., Lakeworst, Fla. 33461

[ * ] Notice: The portion of the term of this patent subsequent to Feb. 14, 2006 has been disclaimed.

[21] Appl. No.: 202,292

[22] Filed: Jun. 6, 1988

Related U.S. Application Data

[63] Continuation-in-part of Ser. No. 116,175, Nov. 3, 1987, Pat. No. 4,804,160, which is a continuation of Ser. No. 92,337, Sep. 1, 1987.

[51] Int. Cl.[4] ..... E04G 15/06

[52] U.S. Cl. ..... 249/207; 52/220; 52/699; 249/39; 249/91; 249/177; 249/219.1; 285/64

[58] Field of Search ..... 249/39, 43, 83, 91, 249/96, 102, 104, 135, 139, 145, 176, 177, 186, 207, 219.1; 52/220, 221, 576, 577, 699–701; 285/56, 64

[56] References Cited

U.S. PATENT DOCUMENTS

| | | | |
|---|---|---|---|
| 1,365,718 | 1/1921 | Ogden | 52/701 |
| 1,603,245 | 10/1926 | Pederson | 52/221 |
| 1,746,696 | 2/1930 | Dows | 249/177 |
| 1,908,796 | 5/1933 | Suchan | 249/177 |
| 2,085,959 | 7/1937 | Donegan | 249/91 |
| 2,249,824 | 7/1941 | Hall | 249/177 |
| 2,286,564 | 6/1942 | Newell | 249/177 |
| 2,694,847 | 11/1954 | Christiansen | 249/177 |
| 2,902,742 | 9/1959 | Matich | 249/91 |
| 3,020,615 | 2/1962 | Peters | 249/114 |
| 3,176,724 | 4/1965 | Prince | 249/177 |
| 3,754,066 | 8/1973 | Black | 52/701 |
| 4,198,798 | 4/1980 | Haydock | 52/699 |
| 4,261,598 | 4/1981 | Cornwall | 285/56 |
| 4,619,087 | 10/1986 | Harbeke | 52/221 |
| 4,619,471 | 10/1986 | Harbeke | 285/158 |
| 4,642,956 | 2/1987 | Harbeke | 52/232 |
| 4,804,160 | 2/1989 | Harbeke | 249/219.1 |

FOREIGN PATENT DOCUMENTS

| | | | |
|---|---|---|---|
| 1170299 | 5/1964 | Fed. Rep. of Germany | 249/177 |
| 2299478 | 8/1976 | France | 52/699 |
| 912507 | 3/1982 | U.S.S.R. | 249/177 |
| 1079798 | 3/1984 | U.S.S.R. | 249/177 |
| 918426 | 2/1963 | United Kingdom | 249/177 |

OTHER PUBLICATIONS

Wallace, M., "Cast Walls and Slab at the Same Time with Tunnel Forms", *Concrete Construction,* Feb. 1985, pp. 201–203.

*Primary Examiner*—James C. Housel
*Attorney, Agent, or Firm*—Griffin, Branigan & Butler

[57] ABSTRACT

Pipe-attachment apparatus (10) for attaching a pipe (22) to a concrete-form wall (16) includes a first attachment device (12,44,56) to be attached to the concrete-form wall and a second-attachment device (14,58) having a radially directed surface for contacting a surface of the pipe and thereby helping to support the pipe. One of the first or second attachment devices includes an axially-extending protrusion (30,70) and the other includes an axially-extending cavity (24,62) for slidably receiving the protrusion. With this arrangement, the second attachment device aids in supporting the pipe from the concrete-form wall during the pouring of concrete, but after the concrete has cured, the first and second attachment devices easily slide away from one another leaving the first attachment device on the concrete form wall and the second attachment device on the pip. In one embodiment a single size first attachment device (80) can be used with a plurality of sizes of second attachment devices (82A and B) for handling different size pipe (98A and B).

11 Claims, 5 Drawing Sheets

AUTOMATICALLY-RELEASABLE PIPE-ATTACHMENT DEVICE

This application is a continuation-in-part of U.S. application Ser. No. 116,175, U.S. Pat. No. 4,804,160, which was a continuation of application Ser. No. 092,337.

BACKGROUND OF THE INVENTION

This invention relates generally to the art of installing pipe networks in buildings and especially to apparatus and methods for embedding pipes and pipe couplings in floors and walls and making fire-retardant pipe networks.

Until relatively recently, pipe networks were normally extended through floors of buildings by forming holes in the floors—e.g. by using void forming devices during the "pouring" of the concrete floors, by knock-out holes, by boring such holes after the floors had been formed, etc.—and thereafter extending pipes through these holes. Normally, the holes were made to be bigger than the pipes to ensure that one could easily extend pipes through the holes. Thereafter, it was necessary for workmen to fill the spaces between the pipes and floors with cement or some other substance to meet fire codes which generally do not allow holes in floors.

There have been a number of patents and other documents published, such as German Offenlegungshrift No. 2,615,428, U.S. Pat. No. 4,453,354 to Harbeke, and U.S. Pat. No. 4,261,598 to Cornwall disclosing the concept of cementing pipe coupling joints into floors when the floors are formed (sometimes called "cast-in couplings") and thereafter mating external pipes to opposite ends of the specially embedded coupling joints.

The Harbeke and Cornwall patents suggest the use of integral flanges on the ends of pipe couplings which can be used to attach the pipe couplings to form walls with nails or screws. It has also been suggested to attach cast-in pipe couplings to forms by means of separate attachment devices which must be removed before the forms are removed. Such devices are described in U.S. Pat. Nos. 4,619,087 and 4,642,956 to Gerold Harbeke. Other suggested devices hold pipes to forms by means of nails, screws and the like which, when the forms are removed rip out of the form or the pipe, such as the above-mentioned U.S. Pat. Nos. 4,261,598 to Cornwall and 4,453,354 to Harbeke. Such devices sometimes harm the forms when they are removed or harm the pipe which must remain in the concrete. A problem with both of these pipe-attachment devices is that once the form is removed they are no longer properly attached to the form and cannot again be used to hold other pipes to the form for casting additional floors of a building without once again locating and mounting pipes on the form. It is an object of this invention to provide a separate pipe-attachment device and method which does not have to be removed from a form prior to the form being removed from the cured concrete and which does not damage either the form or the pipe upon removal of the form from the cured concrete. Further, it is an object of this invention to provide a pipe-attachment device and method which remains attached to the form when the form is removed and is thereby a part of the form so that it can again be used for attaching pipes to the form when the form is used for casting additional floors.

The present inventor has suggested that either a cup or plug attachment device could be attached to a concrete-form wall for extending away from the wall and having radially-directed surfaces for contacting either interior or exterior surface of a pipe or pipe coupling and thereby holding the pipe on the form wall by friction. When the concrete has cured and the form wall is moved downwardly to remove it from the cured concrete, the attachment device remains attached to the form wall and slides away from the pipe coupling that is embedded in the concrete, thereby leaving the attachment device as part of the form to be used for casting another floor. Although this arrangement provides vast improvements over the prior art, it still has several shortcomings. One shortcoming is that in order to provide the proper lateral support for a pipe to a concrete-form wall, the attachment device must protrude outwardly away from the form wall a minimum distance which depends on the diameter of the pipe. If the diameter of the pipe is large, the attachment device must protrude further in order to prevent the pipe from being rotated off the protrusion during the pouring of the concrete. However, some concrete forms, such as tunnel forms, cannot be moved downwardly very much when they are removed from concrete. In this regard, some types of tunnel forms can only be moved one inch downwardly before they are removed laterally from the bottom of a cast floor. Thus, it is an object of this invention, to provide an attachment device for slidably attaching a pipe coupling to a concrete-form wall which provides sufficient support for the pipe coupling during the pouring of concrete, but yet which releases the pipe coupling when the form wall is only moved a very small distance therefrom.

Another shortcoming of the previously-suggested slidable attachment device is that it only provides support at the bottom of a pipe. Thus, if the pipe is relatively thin, it can bend during the pouring of concrete. Therefore, it is an object of this invention to provide a slidable attachment device which can be used to support a pipe not only at its lower end, but along the length of the pipe.

It is a further object of this invention to provide such attachment apparatus which are inexpensive to manufacture and uncomplicated to use.

SUMMARY

According to principles of this invention, a pipe-attachment apparatus includes a first attachment device for being attached to a concrete-form wall and a second-attachment device, separate from the first-attachment device, defining a radially-directed surface for contacting a surface of the pipe and thereby helping to support the pipe. One of the first or second attachment devices includes an axially extending protrusion and the other includes an axially extending cavity for slidably receiving the protrusion and thereby aiding in the support of the pipe during the pouring of concrete, but after the concrete is cured allowing the form to be removed with the first and second attachment devices easily sliding away from one another leaving the first attaching device on the concrete-form wall and the second attachment device on the pipe. In one embodiment of the invention, the first attachment device also defines a radially-directed surface for contacting the surface of the pipe and thereby helping to support the pipe on the concrete-form wall. In another embodiment, the second attachment device is a shaft having an outer diameter which is approximately the same shape and size of the inner surface of a pipe to be supported and having a length which is approximately the same length as the pipe to be supported. In this embodiment, the first attachment device is cup-shaped to extend axially on the outer surface of the pipe so that the second attachment means extends down into the first attachment means on the inside of the pipe. In one embodiment, a single-size first attachment device can be used with a plurality of sizes of second attachment devices for handling different size pipe. In one embodiment the axially extending protrusion includes a tapered radially-directed surface for wedging together with a tapered radially-directed surface of the axially extending cavity.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE PREFERRED EMBODIMENT

Figure 1:
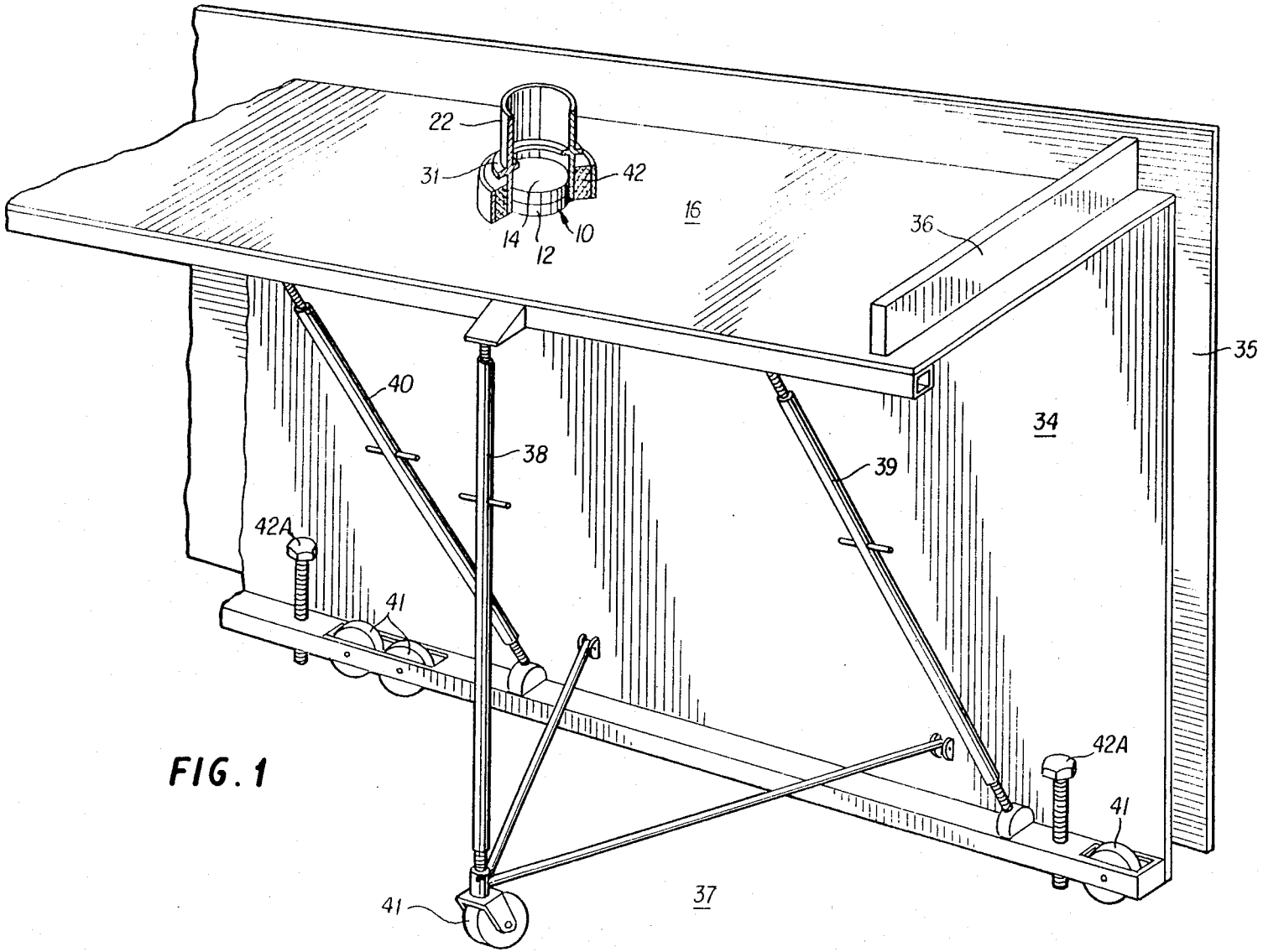
FIG. 1 is an isometric view of a simplified tunnel-type concrete-form wall having a pipe-attachment apparatus of this invention mounted on the top surface thereof with a pipe coupling attached thereto, the pipe coupling being partially cut away and having an intumescent collar thereabout.
Figure 2:
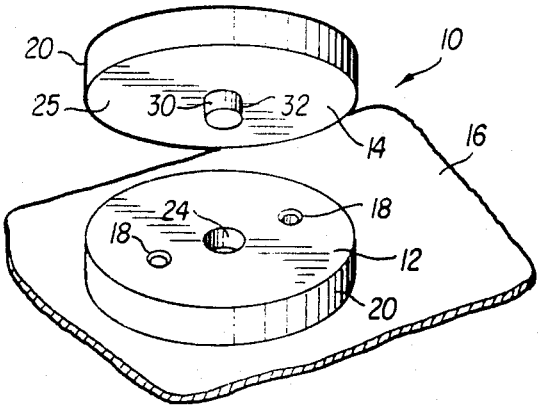
FIG. 2 is an exploded, partially cut away, enlarged view of the pipe-attachment apparatus of FIG. 1 mounted on a concrete form.
Figure 3:
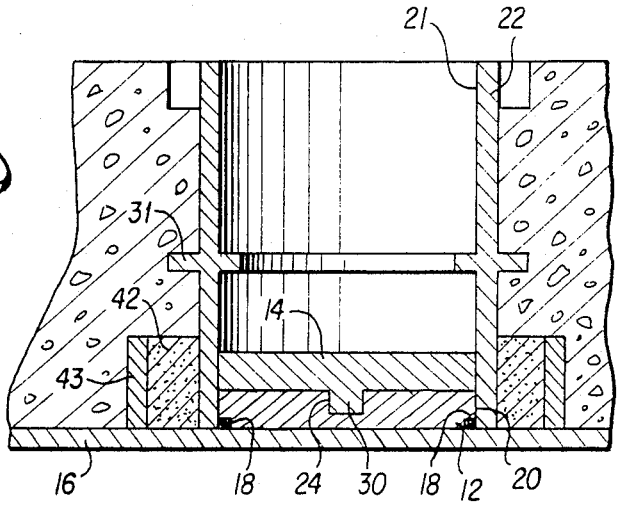
FIG. 3 is a side sectional view of the pipe coupling, pipe-attachment apparatus, intumescent collar, and form wall of FIG. 1, and also including concrete which has been poured in the form of FIG. 1.
Figure 4:
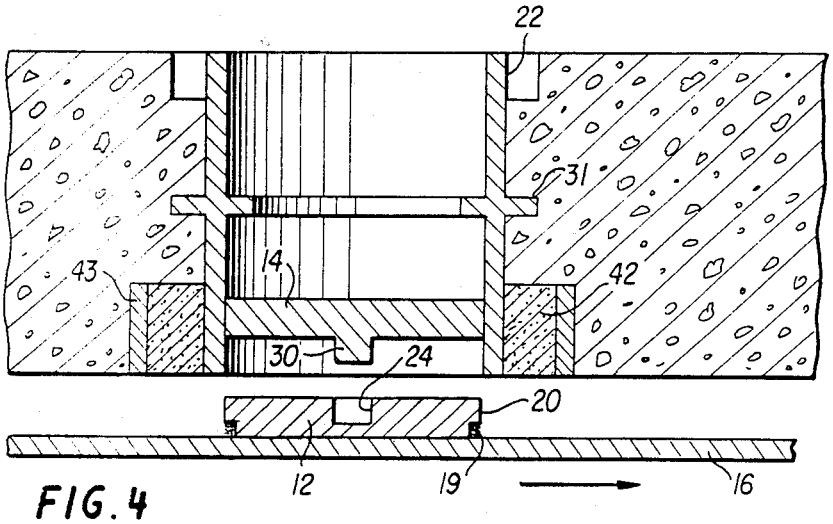
FIG. 4 is a view similar to FIG. 3, but with the form wall shown lowered to free it from the cured concrete.

Looking first at FIGS. 1 and 2, the pipe-attachment apparatus 10 includes a first pipe-attachment device 12 and a second pipe-attachment device 14. The first pipe-attachment device 12, as can be seen in FIG. 3, is for attachment to a concrete-form wall 16 by means of fasteners 18 which can be screws, nails, rivets, welds or the like. In FIGS. 3 and 4 the fastener is shown to be a weld and in order to accommodate the weld material 18 an annular groove 19 is placed in the first pipe attachment device 12 at the base thereof. The first pipe-attachment device 12 is cylindrical in shape having a radially-directed outer surface 20 which is approximately the same shape and size as the inner surface 21 of a pipe coupling 22 to be held to the concrete form wall 12 while concrete is being poured. The annular groove 19 insets the weld material 18 so that the pipe coupling 22 can be pulled down over it until it comes into contact with the concrete form wall 16. The first pipe-attachment device 12 also has an axially directed, cylindrically-shaped cavity 24 positioned at the axis thereof. The axially-directed cavity 24 can extend completely through the first pipe-attachment device 12 or almost through it as in the depicted embodiment.

A main body 25 of the second pipe-attachment device 14 is also cylindrically shaped and also has a radially directed outer surface 20 which is approximately the same shape and size as the inner surface 21 of the pipe 22 to be supported by the pipe-attachment apparatus 10. In addition, the second pipe-attachment device 14 has an axial protrusion 30 protruding away from the main body body 25 at the axis thereof. The axial protrusion 30 is also cylindrically shaped, having a radially directed surface 32 which is approximately the same diameter and shape as the axially-directed cavity 24 of the first pipe-attachment device 12. Thus, the second pipe-attachment device 14 can be placed on top of the first pipe-attachment device 12 with the axial protrusion 30 extending into the axially-directed cavity 24 so that the second pipe-attachment device 14 is not only supported vertically by the first pipe-attachment device 12 but is also thereby laterally supported.

The pipe-attachment apparatus 10 of FIGS. 1–4 is shown in FIG. 1 mounted on a tunnel-type form. Such a form is used for simultaneously casting a wall, between form plates 34 and 35 and a floor/ceiling between form plates 35,36 and 16. The concrete-form plate, or wall, 16 is held in position relative to a floor 37 and the form plate 34 by means of turnbuckles 38, 39, and 40 and bolts 42. The end form plate 36 is held to the concrete form wall 16 and the form plates 34 and 36 are held together by means of clamps which are not shown in FIG. 1. In order to use the tunnel concrete form of FIG. 1, it is rolled into position on wheels 41 and the turnbuckles 38, 39 and 40 and bolts 42 are rotated to place the concrete form walls 16 and 34 in appropriate positions. Similarly, clamps holding the various other form plates in appropriate positions are tightened or loosened as is required. Thereafter, concrete is poured onto the concrete form wall 16 and between the form plates 34 and 36 and allowed to cure. Once the concrete has cured, the turnbuckles 38, 39 and 40 and bolts 42 are loosened as are the other clamps and the tunnel form is rolled laterally to a new position. It should be appreciated that it is not desirable, and in many cases, not possible, to lower the concrete form wall 16 to any large degree, and in some cases, it can only be moved downwardly one inch from cured concrete.

Now looking at operation of the pipe-attachment apparatus 10 of this invention, the first pipe-attachment device 12 is attached to the concrete form wall 16 at a location at which a pipe string is to pass through a floor/ceiling cast on the concrete form wall 16. Thereafter, the second pipe-attachment device 14 is placed on top of the first pipe-attachment device 12 with the axial protrusion 30 extending down into the axially-directed cavity 24 of the first pipe-attachment device. The pipe coupling 22, with an intumescent collar 42 and metal, heat conducting band 43, thereabout, is then forced down over the first and second pipe-attachment devices 12 and 14 of the pipe-attachment apparatus 10 so as to occupy the position shown in FIG. 3. In this arrangement, the pipe coupling 22 is held by friction both on the first pipe-attachment device 12 and the second pipe-attachment device 14 and is given, thereby, support. In this respect, the second pipe-attachment device 14 provides support because it is, in turn, supported by the axial protrusion 30 which extends into the axially-directed cavity 24. The second pipe-attachment device 14 is held more firmly by the pipe 22 than it is by contact between the axial protrusion 30 and the axially-directed cavity 24 such that, when the form wall 16 is lowered, as is shown in FIG. 4, the second pipe-attachment device 14 remains in the pipe 22 while the first pipe-attachment device 12 remains affixed to the concrete form wall 16. The pipe 22, if it is a specially designed coupler, has a riser protrusion 31 on it to ensure that it remains in the concrete. The concrete form wall 16 need only be lowered the length of the first pipe-attachment device 12 which in the preferred embodiment is less than one inch and usually around ¾ of an inch. Similarly, the axial length of the second pipe-attachment device 14 is around ¾ of an inch. Thus, these two members together are around 1½ inches in axial length. It should be kept in mind, however, that the necessary lengths of these elements are determined to some extent by the diameter of the pipe 22 being thereby supported, however, it is thought that the first pipe-attachment device 12 must be less than one inch in order to be properly used with a tunnel form of FIG. 1.

In the preferred embodiment, the first and second pipe-attachment devices 12 and 14 can be constructed of either a plastic or a metal. In one embodiment, the second pipe-attachment device 14 is constructed of a hard plastic while the first pipe-attachment device 12 is constructed of steel. In this respect, the first pipe-attachment device 12 should be at least as strong as the concrete form wall to which it is affixed and of which it becomes a part. The second pipe-attachment device 14 can be one integral part, with the axial protrusion 30 being integral with the main body 25 thereof, however, in one embodiment as is shown in FIG. 4, it is a separate member held to the main body by means of a rivet.

Figure 5:
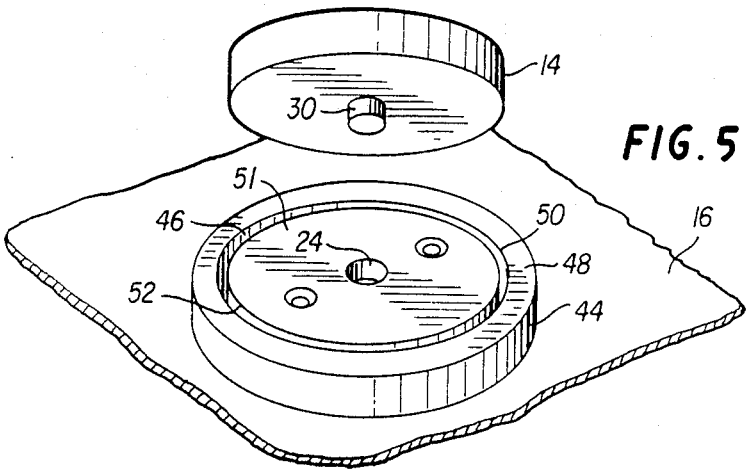
FIG. 5 is a isometric, exploded, partially cut away, view of another embodiment pipe-attachment apparatus of this invention attached to a form wall.
Figure 6:
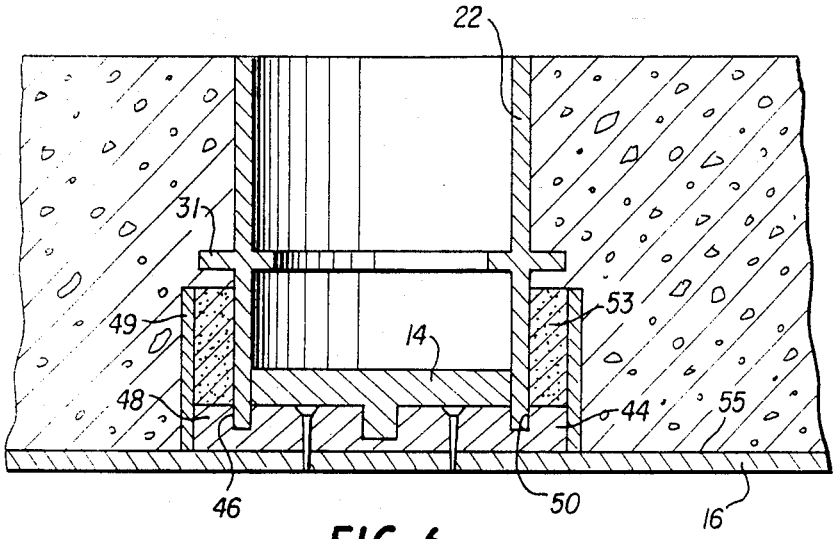
FIG. 6 is a side sectional view of the pipe-attachment apparatus of FIG. 5 holding a pipe coupling having an intumescent collar thereabout with concrete on the form wall.

FIGS. 5 and 6 show another embodiment of this invention which is similar to the FIGS. 1–4 embodiment with the exception that a first attachment device 44 forms an annular groove 46 for slidably receiving the pipe coupling 22 and there is, therefore, an outer wall 48 having an inner radial surface 50 for contacting the outer surface of the pipe coupling 22 and an inner plug 51 having an outer radial surface 52 for contacting the inner surface of the pipe coupling 22. The annular groove 46 extends almost completely through the first attachment device 44 in the axial direction, but not quite, as can be seen in FIG. 6. Thus, the first attachment device 44 contacts both the outer and inner surfaces of the pipe coupling 22 and thereby provides somewhat more support therefor than the first pipe-attachment device 12 of the FIGS. 1–4 embodiment. Otherwise, the second pipe-attachment device 14 of FIGS. 5 and 6 is exactly like the second pipe-attachment device 14 of the FIGS. 1–4 embodiment, having an axial protrusion 30 for extending in an axially-directed cavity 24 of the first attachment device 44. In the FIGS. 5 and 6 embodiment, it is necessary to place the intumescent collar 53 somewhat higher on the pipe coupling 22 in order to leave room for the outer-cup wall 48. In this case a metallic, heat-conductive, band 49 can be longer than the intumescent collar 53 so that it extends approximately to a lower surface 55 of a barrier being cast. However, once the first attachment device 44 is removed with the form wall 16, it will leave a space for heat from a fire to reach the intumescent collar 52.

Basically, the pipe-attachment apparatus of FIGS. 5 and 6 function in the same manner as the pipe-attachment apparatus 10 of FIGS. 1–4 in that the concrete form wall 16 and the first attachment device 44 must only be moved a small distance in order to clear the second pipe-attachment device 14, which remains with the pipe coupling 22, as well as the pipe coupling 22.

Figure 7:
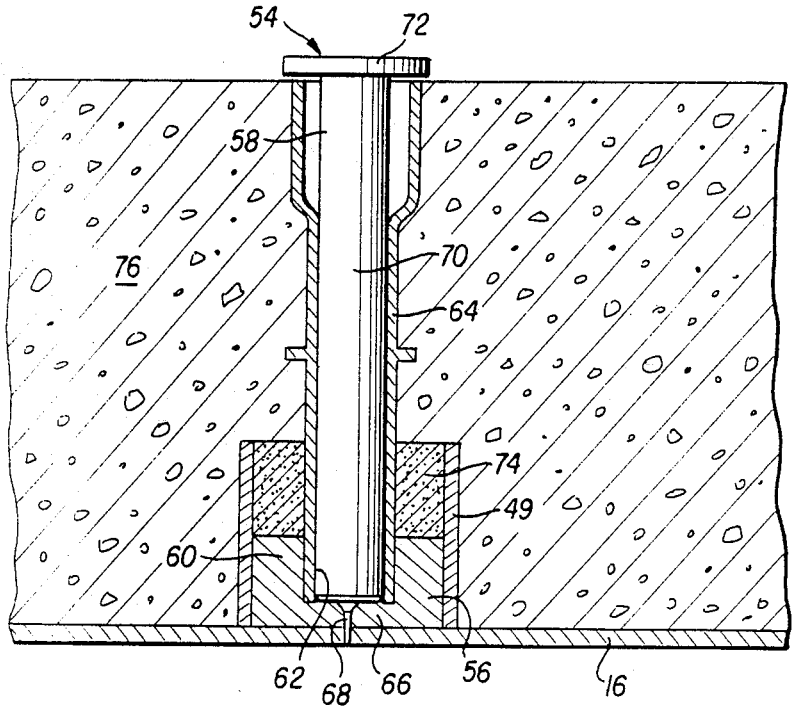
FIG. 7 is a side sectional view of another embodiment of the pipe-attachment apparatus of this invention mounted on a form wall for holding a pipe having an intumescent collar wrapped thereabout, with concrete held by the form wall.

Looking now at the FIG. 7 embodiment of the invention, in this embodiment, a pipe-attachment apparatus 54 includes a first pipe-attachment device 56 and a second pipe-attachment device 58. The first pipe-attachment device 56 is in the shape of a cup with a circular annular wall 60 having a cavity with a radially directed circular surface 62 of a size and shape for receiving the outer surface of a pipe, or pipe coupling, 64. The first pipe-attachment device 56 includes a floor 66 which is attached to the concrete form wall 16 by a fastener 68. Again, the fastener 68 can be a weld, a screw, a rivet or the like.

The second pipe-attachment device 58 is a cylindrically-shaped shaft 70 having an enlarged head 72 on the outer end. The cylindrically-shaped shaft 70 has a round outer surface which is approximately the same size as the inner surface of the pipe coupling 64 and its length is about the same length as the pipe coupling 64. Thus, the head 72 is positioned just outside of the upper end of the pipe coupling 64 while the other end of the cylindrically-shaped shaft 70 is approximately at the opposite end of the pipe coupling 64.

In use, the first pipe-attachment device 56 is attached to the concrete form wall 16 at a location at which a pipe is to extend through a floor being cast thereon and a pipe or pipe coupling 64 is forced into the cavity thereof such that the radially-directed circular surface 62 of the first pipe-attachment device 56 tightly holds the end of the pipe coupling 64. The cylindrically-shaped shaft 70 of the second pipe-attachment device 58 is inserted into the bore of the pipe coupling 64 so that it also extends down into the first pipe-attachment device 56. Thus, the cylindrically-shaped shaft 70 provides additional support for the pipe coupling 64 such that it will not rotate out of the first pipe-attachment device 56 nor will it bend above the first pipe-attachment device 56.

In one embodiment, both the first and second pipe-attachment first devices 56 and 58 are constructed of plastic, however the first pipe-attachment device 56 could easily be constructed of steel, thus allowing weld material to be used for fastening it to the concrete form. Again, an intumescent wrap, or collar, 74 can be placed about the pipe coupling 64 above the first pipe-attachment device 56 and once the first pipe-attachment device 56 is removed with the concrete form wall 16 a cavity will be left about the pipe coupling 64 to allow heat to reach the intumescent wrap 74. Heat exchangers could be added to conduct heat from the lower surface of a floor 76 up to the intumescent wrap 74 where it is thought necessary.

Figure 8:
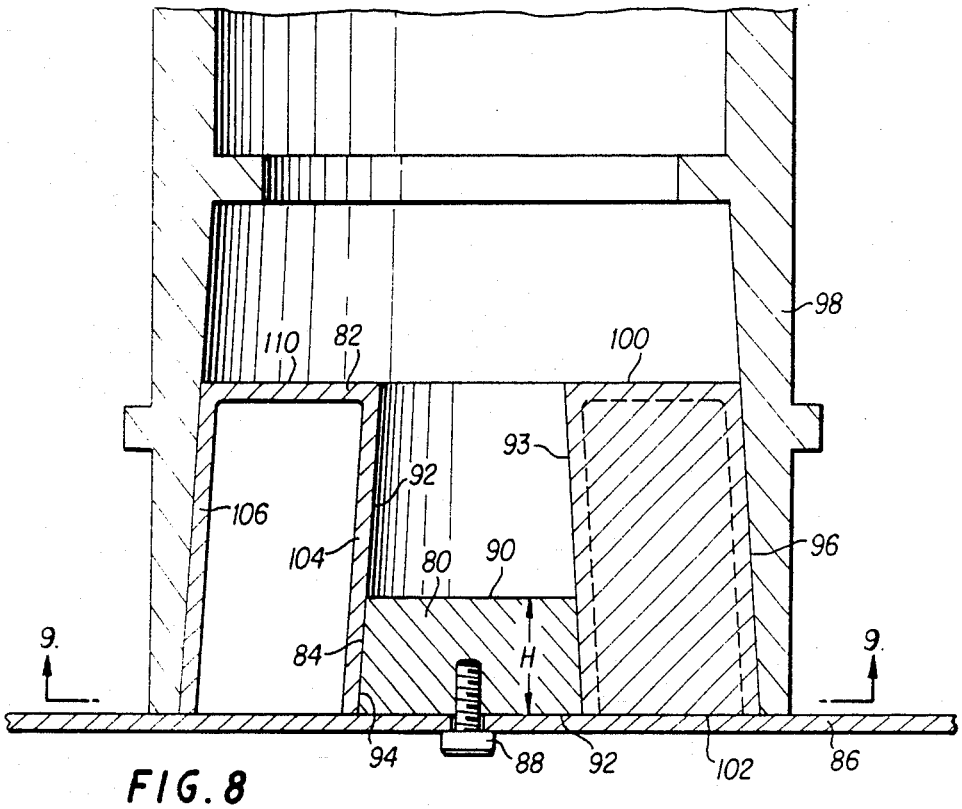
FIG. 8 is a side sectional view of another embodiment of the pipe-attachment apparatus of this invention mounted on a form wall and supporting a pipe coupling.
Figure 9:
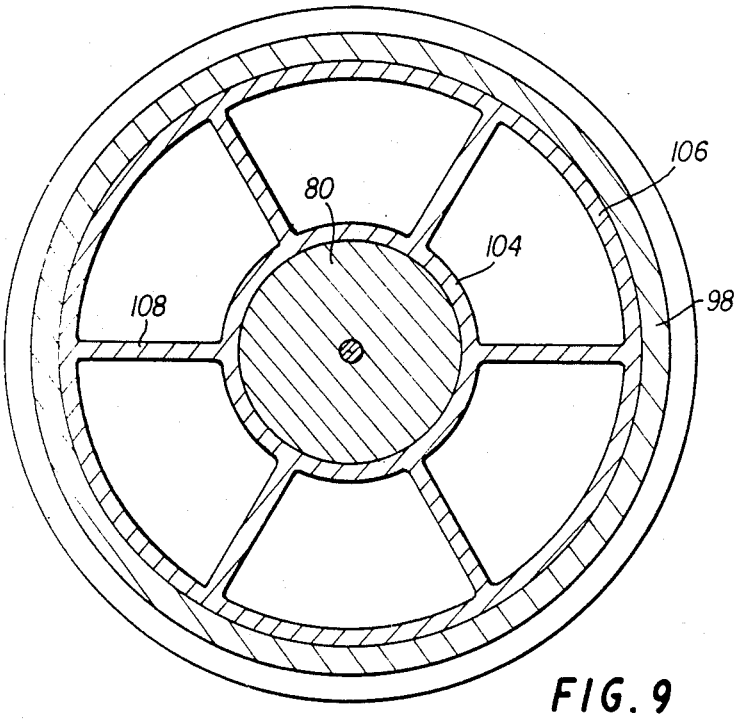
FIG. 9 is a sectional view taken on line 9—9 in FIG. 8.
Figure 10:
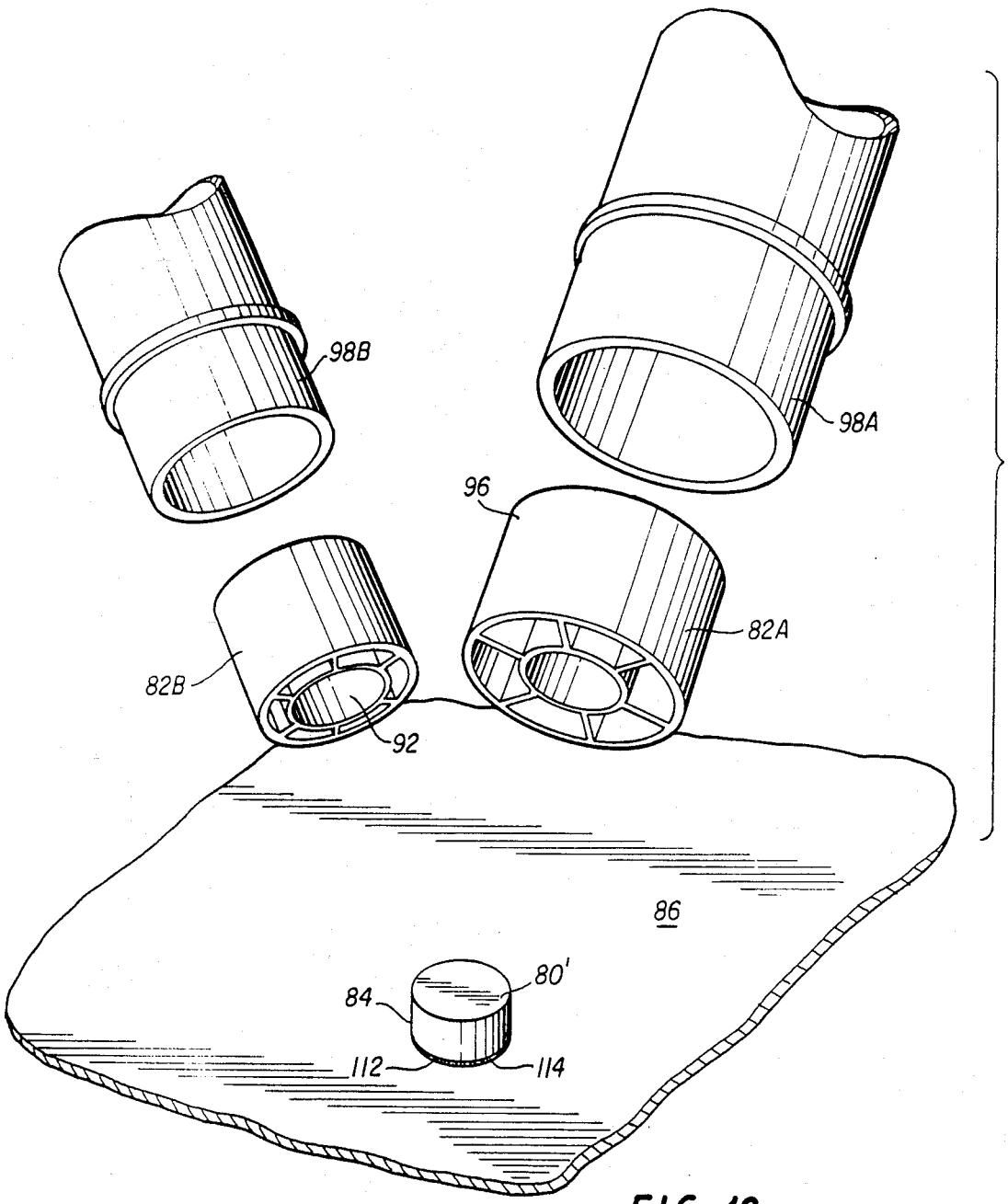
FIG. 10 is an exploded, isometric, view of an embodiment similar to the FIGS. 8–9 embodiment being used alternately with two different size pipes.

FIGS. 8-10 depict yet another embodiment of this invention wherein a first attaching device 80 is constructed of a metal, such as steel, and a second attaching device 82 is constructed of a thin-wall, frangible, plastic, such as styrene plastic.

The first attaching device 80 is a substantially solid piece of metal which is almost cylindrical in shape, however, its radially outwardly directed surface 84 is actually radially, inwardly, tapered in a direction extending away from a form 86 to which the first attaching device 80 is fastened by means of a bolt 88. In this regard, in one embodiment, a top surface 90 of the first attaching device 80 has a diameter of approximately 2 11/32 inches while a bottom surface 92 thereof has a diameter of 2 12/32 inches. The drawing in FIG. 8 is exaggerated with regard to this taper so that the taper is visible therein.

The second attaching device 82 defines a complementary, circular-in-cross section cavity 92 whose radially inwardly directed surface 93 has a diameter at a bottom end 94 thereof which is approximately 2 23/64 inches. thus, this bottom end 94 of the cavity 92 can easily fit over the top surface 90 of the first attaching device 80 and as the second attaching device 82 is shoved down on the first attaching device 80, the plastic of which the second attaching device is made, stretches slightly to cause a wedged, tight fit between first and second attaching devices 80 and 82.

Similarly, a radially outwardly directed surface 96 of the second attaching device 82, for a four inch pipe coupler 98 is also tapered, having a diameter of approximately 4 15/32 inches at its top end 100 and a diameter of approximately 4½ inches at a bottom end 102 thereof. Again, the taper is shown to be exaggerated in FIG. 8. Such a taper corresponds to the shape of many couplers 98 so that when a coupler 98 is pressed onto the second attaching device 82, as is shown in FIG. 8, it will be wedged tightly thereon.

The second attaching device 82 is molded to have relatively thin walls so that it can be easily destroyed under appropriate circumstances to be described below. In any event, the second attaching device 82 is molded to have an inner circular wall 104 and an outer circular wall 106 interconnected by radial ribs 108. In the depicted embodiment, there is also a top wall 110, however, this is not necessary. As can be seen in FIGS. 8 and 9, the inner circular wall 104 defines the cavity 92 which is defined by the radially inwardly directed surface 93 and the outer circular wall 106 defines the radially outwardly directed surface 96. Each of these walls, as well as the ribs, has a thickness of around ⅛ inch or less.

The first attaching device 80, in one embodiment, is approximately ¾ inch in height H while the second attaching device 82 is somewhat more than 1¾ inches in height. In any event, the first attaching device 80 forms the entire protrusion that protrudes into the second attaching device 82 so that the radially outwardly directed surface 96 of the second attaching device 82 completely surrounds the radially outwardly directed surface 84 of the first attaching device 80.

Describing next use of the device of FIGS. 8 and 9, with reference to a slightly modified embodiment shown in FIG. 10, a single first attaching device 80' is affixed to the form 86. In the FIG. 10 embodiment a first attaching device 80' has an inwardly directed welding groove 112 at a lower end thereof so that weld material 114 affixing the first attaching device 80' to the form 86 does not extend outside the diameter of the radially outwardly directed surface 84. Thus, as in the other embodiments of this invention, the first attaching device 80' becomes a part of the form 86. Otherwise the first attaching device 80' is the same as the first attaching device 80 of FIG. 8. Thereafter, this single first attaching device 80' can be used with any one of a plurality of sizes of second attaching devices 82A and 82B and first and second size pipe couplers 98A and 98B. For example, the pipe coupler 98A could be a coupler for four inch pipes, in which case, the second attaching device 82 would have a radially outwardly directed surface 96 with approximately a 4½ inch diameter. Of course, the cavity 92 would have a diameter for tightly fitting the radially outwardly directed surface 84 of the first attaching device 80 as is described above. The pipe 98B could be a three inch pipe in which case, a radially outwardly directed surface of the second attaching device 82B would have approximately a 3½ inches diameter while the cavity 92 thereof would be the same size as the cavity 92 of the second attaching device 82A. Of course the ribs of the second attaching device 82B are shorter than the ribs of the second attaching device 82A.

No matter which size second attaching device 82 and pipe 98 are used with the first attaching device 80', they function in a similar manner. That is, once the form 86, with the first attaching device 80' affixed thereto is in a position to receive concrete, an appropriate second attaching device 82A or B is pressed thereon, with its slightly tapered radially inwardly directed surface 92 being wedged onto the slightly tapered radially outwardly directed surface 84 so that the bottom end 102 of the appropriate second attaching device 82A or B contacts the form 86. Thereafter, an appropriate pipe coupler 98A or B is forced onto the appropriate second attaching device 82A or B and, again, the slightly tapered surface wedges tightly on the pipe coupler. It is a good idea to put a lubricant on the radially outwardly directed surface 84 of the first attaching device 80' before the appropriate second attaching device 82A or B is wedged thereon so that these members slip apart more easily. In any event, after the appropriate second attaching device 82A or B and the appropriate pipe 98A or B are in place, concrete is poured into the form 86 around the pipe 98A or B and allowed to hardened. Thereafter, the form 86, which is most likely a tunnel form, can only be lowered about one inch in order to remove it. In this regard, when the form 86 is lowered, the first attaching device 80', which is affixed thereto, follows it and moves out of the cavity 92 of the second attaching device 82A or B so that the first attaching device 80' clears not only the pipe 98 but also hardened concrete in the form 86 and the second attaching device 82A or B. Because a lubricant was placed on the radially outwardly directed surface 84, there should be relative movement between the first and second attaching devices 80' and 82A or B with the second attaching device 82A or B staying in place in its pipe 98A or B. However, should the second attaching device 82A or B follow the first attaching device 80' by sliding out of its pipe 98A or B, when the form 86 is moved laterally, the second attaching device 82A or B, which is constructed of thin plastic walls, and therefore frangible, will be destroyed, shearing between the first attaching device 80′ and the embedded pipe couling 98A or B when the form 86 is moved laterally.

It will be appreciated by those of ordinary skill in the art that the pipe-attachment apparatus described herein provide additional support for pipes and pipe couplings thereby supported but without requiring first attachment devices which are affixed to forms to protrude extremely long distances from the forms so that the forms must be moved great distances from barriers thereby cast. It will also be appreciated by those of ordinary skill in the art that the apparatus described herein are extremely uncomplicated but yet durable and allow the construction of fire retardant barriers. Further, the apparatus allow attachment devices to stay on form walls so that the form walls can be used for casting additional floors without relocating attachment devices thereon.

While the invention has been particularly shown and described with reference to preferred embodiments, it will be understood by those skilled in the art that various changes in form and detail may be made therein without departing from the spirit and scope of the invention. For example, it would be possible to use either a pipe or a pipe coupling with the pipe-attachment apparatus. If a pipe were used with the pipe-attachment apparatus 10 of FIGS. 1–4, it would be necessary to also include a frangible spacer at the lower end of the pipe so that a pipe coupling could be attached to the outer surface of the pipe. Also, a fire stop collar could be used on the coupler 98 of FIGS. 8–10, however, none is shown thereon for purposes of simplicity. Rather than including a welding groove 112 on the first attaching device 80′ it would also be possible to include grooves, notches, or offsets at the bottom ends of the walls forming the cavities 92 of the second attaching devices 82A and B for accommodating weld material about the base of the first attaching device 80′.

The embodiment of the invention in which an exclusive property or privilege is claimed is defined as follows:

1. Pipe-attachment apparatus for attaching an elongated pipe to a concrete form wall, with an axis of said pipe extending laterally away from said form wall, said apparatus including:

a first attachment means for being attached to said concrete form wall and extending axially away from said form wall, laterally to said form wall, said first attachment means having an outwardly, radially directed, outer surface for helping to support said pipe on said concrete form wall;

a second attachment means separate from said first attachment means and said pipe, said second attachment means defining a radially outwardly directed surface for tightly contacting a radially inwardly directed, internal surface of said pipe to have frictional engagement therewith, thereby helping to support said pipe on said concrete form wall, said second attachment means contacting only said radially inwardly directed internal surface of said pipe, said second attachment means radially outwardly directed surface being tapered radially inwardly away from said concrete form wall when said second attachment means is mounted on said first attachment means, said second attachment means defining a cavity extending axially, laterally away from said concrete form wall for substantially completely receiving said first attachment means, said cavity defining a radially inwardly directed surface corresponding to said radially outwardly directed outer surface of said first attachment means;

said radially outwardly directed outer surface of said first attachment means and said radially inwardly directed cavity surface of said second attachment means being of approximately the same size for fitting tightly together but allowing sliding axial movement between them without damaging either member;

means for attaching said first attachment means to said concrete form wall to permit sliding axial movement between said first attachment means and said cavity surface thereby aiding in supporting said pipe on said concrete form wall during a pouring of concrete, but after the concrete is cured allowing the form wall to be removed in an axial direction with said first and second attachment means sliding away from one another leaving the first attachment means on the concrete-form wall and the second attachment means on said pipe.

2. Pipe-attachment apparatus as in claim 1 wherein said means for attaching said first attachment means to said concrete form wall includes a radially inwardly directed annular groove in said outer surface at an end thereof to be attached to said concrete form wall for forming a radially outwardly directed welding surface positioned radially inwardly from said first attachment means outer surface for allowing said first attachment means to be welded to said concrete form wall with weld material being inside said radially inwardly directed surface of said second attachment means cavity so that said second attachment means is not hindered from contacting said form wall by such weld material.

3. Pipe attachment apparatus as in claim 1 wherein said first attachment means radially outwardly directed outer surface is tapered radially inwardly extending away from the concrete form wall and said radially inwardly directed surface of said second attachment means cavity is tapered to correspond to the taper of said first attachment means radially outwardly directed outer surface whereby said tapered radially directed surfaces make tight, wedging contact one with the other when the first attachment means is inserted into the cavity.

4. A pipe attachment apparatus as in claim 3 wherein said first attachment means is metallic and said second attachment means is a frangible, non-metallic, material.

5. Pipe attachment apparatus as in claim 1 wherein said first attachment means is metallic and said second attachment means is a frangible non-metallic material.

6. Pipe attachment apparatus for attaching one of a plurality of different size elongated pipes to a concrete form wall, with an axis of said one of said pipes extending laterally away from said form wall, said apparatus including:

a first attachment means for being attached to said concrete form wall and extending axially away from said form wall, said first attachment means having an outwardly, radially-directed outer surface for helping to support one of said pipes on said concrete form wall;

a plurality of second attachment means separate from said first attachment means defining a radially outwardly directed surface for tightly contacting a radially inwardly directed, internal surface of a respective one of said pipes to have frictional engagement therewith thereby helping to support said pipe on said concrete form wall, said second attachment means contacting only said radially inwardly directed internal surface of said pipe, said second attachment means defining a cavity extending axially, laterally away from said concrete form wall substantially completely receiving said first attachment means, said cavity defining a radially inwardly directed surface corresponding to said radially outwardly directed outer surface of said first attachment means, some of said second attachment means radially outwardly directed surfaces being of different sizes corresponding to the different size pipes;

said radially outwardly directed outer surface of said first attachment means and said radially inwardly directed cavity surface of each said second attachment means being of approximately the same size for fitting tightly together but allowing sliding axial movement between them without damaging either member, means for attaching said first attachment means to said concrete form wall to permit sliding axial movement between said first attachment means and each said cavity surface thereby aiding in supporting a respective one of said pipes on said concrete form wall during a pouring of concrete, but after the concrete is cured allowing the form wall to be removed in an axial direction with said first and second attachment means sliding away from one another leaving the first attachment means on the concrete-form wall and the second attachment means on said pipe.

7. Pipe-attachment system as in claim 6 wherein said first attachment means radially outwardly directed outer surface is tapered radially inwardly extending away from the concrete form wall and said radially inwardly directed surface of said cavity of each said second attachment means is tapered to correspond to the taper of said first attachment means radially outwardly directed outer surface, whereby said tapered radially directed surfaces make tight contact one with the other when the first attachment means is inserted into the cavity.

8. Pipe-attachment system as in claim 7 wherein said radially outwardly directed surface of each of said second attachment means is tapered radially inwardly extending away from said concrete form wall when said second attachment means is mounted on said first attachment means.

9. A pipe attachment apparatus as in claim 6 wherein said first attachment means is metallic and each of said second attachment means is a frangible non-metallic material.

10. A female pipe attachment apparatus for attaching an elongated pipe to a concrete form wall with an axis of said pipe extending laterally away from said form wall, said apparatus including a pipe-attachment device comprising;

an axially-extending wall means for extending away from said concrete form wall, said axially-extending wall means defining a radially, outwardly directed outer surface for tightly contacting an inner surface of said pipe about the inner surface thereof and holding thereto by friction, but allowing said wall means to be removed therefrom if sufficient axial force is applied thereto;

said radially-directed outer surface being sufficiently axially long and shaped and sized to tightly fit said surface of said pipe about the inner surface thereof such that said female pipe attachment device can be affixed to said form to become a part thereof and thereafter a pipe can be pressed down onto said pipe attachment device to be held in place on said form during the pouring of concrete and after the concrete is cured the form can be removed while leaving the attachment device affixed to the form;

said axially-extending wall means including a radially inwardly directed annular groove in said outer surface at an end thereof to be attached to said concrete form wall for forming a radially outwardly directed welding surface positioned radially inwardly from said first attachment means outer surface;

weld material applied between said concrete-form wall and said axially-extending wall means at said welding surface for allowing said axially-extending wall means to be welded to said concrete form wall with weld material being inside said radial, outwardly directed, outer surface whereby said pipe is not prevented from contacting said concrete form wall by such weld material.

11. Pipe-attachment apparatus for attaching an elongated pipe to a concrete form wall, with an axis of said pipe extending laterally away from said form wall, said apparatus including:

a first attachment means for being attached to said concrete form wall and extending axially away from said form wall, laterally to said form wall, said first attachment means having an outwardly, radially directed, outer surface for helping to support said pipe on said concrete form wall;

a second attachment means separate from said first attachment means and said pipe, said second attachment means defining a radially outwardly directed surface for tightly contacting a radially inwardly directed, internal surface of said pipe to have frictional engagement therewith, thereby helping to support said pipe on said concrete form wall, said second attachment means contacting only said radially inwardly directed internal surface of said pipe, said second attachment means defining a cavity extending axially, laterally away from said concrete form wall for substantially completely receiving said first attachment means, said cavity defining a radially inwardly directed surface corresponding to said radially outwardly directed outer surface of said first attachment means;

said first attachment means including means for attaching said first attachment means to said concrete form wall said means for attaching including a radially inwardly directed annular groove in said outer surface of said first attachment means at an end thereof to be attached to said concrete form wall for forming a radially outwardly directed welding surface positioned radially inwardly from said first attachment means outer surface for allowing said first attachment means to be welded to said concrete form wall with weld material being inside said radially inwardly directed surface of said second attachment means cavity so that said second attachment means is not hindered from contacting said form wall by such weld material;

said radially outwardly directed outer surface of said first attachment means and said radially inwardly directed cavity surface of said second attachment means being of approximately the same size for fitting tightly together but allowing sliding axial movement between them without damaging either member;

weld means for attaching said first attachment means at said welding surface to said concrete form wall to permit sliding axial movement between said first attachment means and said cavity surface thereby aiding in supporting said pipe on said concrete form wall during a pouring of concrete, but after the concrete is cured allowing the form wall to be removed in an axial direction with said first and second attachment means sliding away from one another leaving the first attachment means on the concrete-form wall and the second attachment means on said pipe.

* * * * *